United States Patent [19]

Prenn

[11] 4,050,514

[45] Sept. 27, 1977

[54] PARAFFIN SUCKER ROD SCRAPER AND ROD CENTRALIZER

[75] Inventor: Otto E. Prenn, Sherwood Park, Canada

[73] Assignee: The Steel Company of Canada, Limited, Hamilton, Canada

[21] Appl. No.: 720,253

[22] Filed: Sept. 3, 1976

[51] Int. Cl.[2] ..... E21B 37/02

[52] U.S. Cl. ..... 166/176

[58] Field of Search ..... 166/176, 241, 173

[56] References Cited

U.S. PATENT DOCUMENTS

| | | | |
|---|---|---|---|
| 1,272,253 | 7/1918 | Green | 166/173 |
| 2,309,791 | 2/1943 | Sanders | 166/173 |
| 2,794,617 | 6/1957 | Yancey | 166/241 |
| 3,109,501 | 11/1963 | Pugh | 166/241 |
| 3,364,998 | 1/1968 | Sable | 166/176 |
| 3,438,404 | 4/1969 | Tripplehorn | 166/176 |

*Primary Examiner*—James A. Leppink

*Attorney, Agent, or Firm*—Sim & McBurney

[57] ABSTRACT

This invention provides a sucker rod scraper having two main portions. An inner portion is constituted by a plastic body member affixed to and surrounding the sucker rod, the body member including an elongated cylindrical portion with a plurality of longitudinal fins extending radially outwardly therefrom and spaced angularly therearound. The second part is a plastic ring member adapted to encircle the central body adjacent the fins, the ring member having an inner diameter greater than the outer diameter of the adjacent part of the inner portion, whereby to allow a passageway for fluid or liquid to flow past the sucker rod scraper. Means are provided for retaining the ring member adjacent the fins, this being constituted in the preferred embodiment by the provision of inward recesses along the outer edges of each fin, with the ring member being dimensioned so as to permit it to register within the recesses, whereby the ring can rotate in position but cannot move longitudinally.

6 Claims, 4 Drawing Figures

FIG. 1
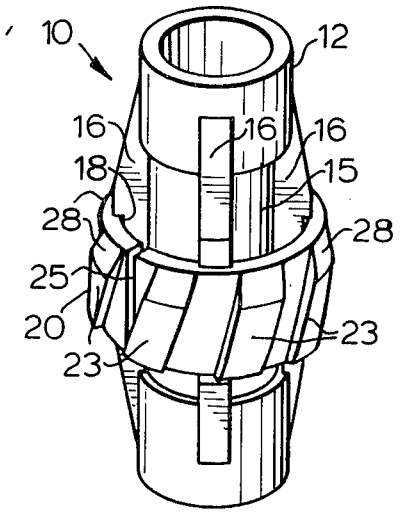
FIG. 2
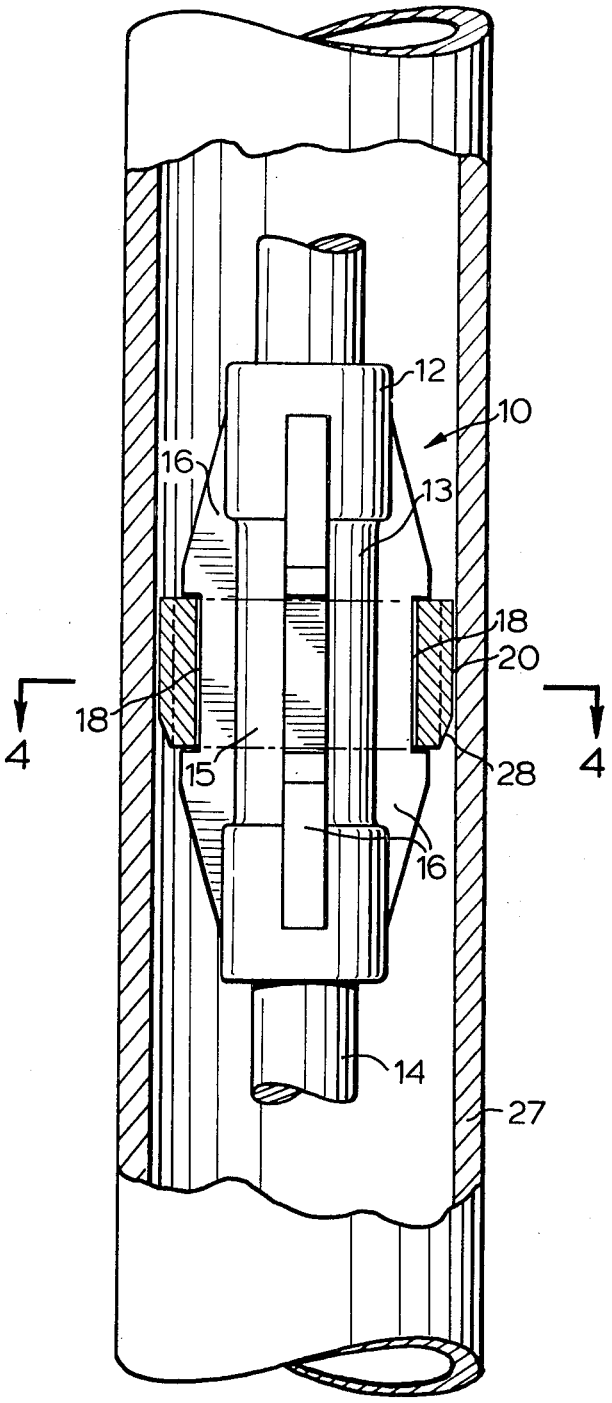
FIG. 3
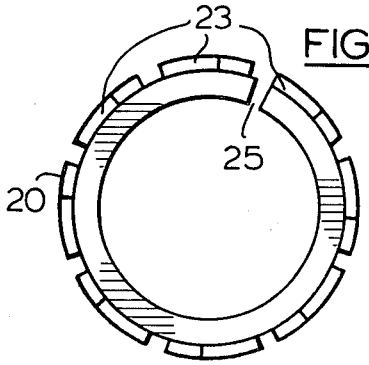
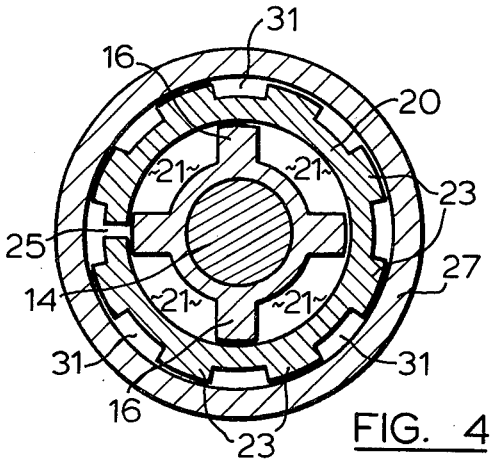
FIG. 4

PARAFFIN SUCKER ROD SCRAPER AND ROD CENTRALIZER

This invention relates generally to scraper attachments for sucker rods utilized in the oil-drilling industry. In the Arctic and elsewhere, very deep oil wells extending thousands of feet into the earth provide quantities of oil which often includes paraffin materials that are liquid at the temperature obtaining in the bottom of the well but which gradually solidify and cake out against the sides of the well pipe toward its upper end where the temperatures are lower. Typically, the well tubing or pipe may have an inside diameter of about two inches, and a sucker rod of about ⅝ inch diameter is composed of numerous sections coupled together at intervals and stretching down the entire length of the well. The sucker rod reciprocates up and down through a given stoke length, and raises the crude oil upwardly during the upward stoke. On the downward stroke, a flap valve arrangement closes at the bottom of the pipe to prevent oil from moving back downwardly, and this means that the sucker rod moves downwardly past the substantially stationary crude oil sitting in the pipe during the downward stoke.

Several approaches to the problem of scraping paraffin caked out on the interior wall of the well tube have already been made. Steel scrapers have been affixed at intervals to the rod, to define outwardly projecting fins adapted to slice or cut through the paraffin in order to dislodge it to be carried upwardly and out of the well with the rest of the crude oil. Problems arise with this kind of scraper due to slipping of the scrapers on the rod, the necessity for rod rotating equipment in order to scrape the full periphery of the interior of the tubing, mechanical damage to the tubing as a result of contact with the metal scrapers, paraffin build-up on the scrapers themselves, and the difficulty of replacing the scrapers when they have become worn.

It is an aspect of this invention to provide a sucker rod scraper of improved construction which allows the above disadvantages to be minimized or eliminated.

Accordingly, this invention provides a sucker rod scraper comprising:

- a plastic body member adapted to be affixed to the sucker rod, the body member including an elongated, generally cylindrical portion to concentrically surround the sucker rod, a plurality of longitudinal fins extending radially from said cylindrical position and spaced angularly from each other, the fins being indented between their ends,
- a plastic ring member adapted to encircle said body member adjacent the fins within the indentations of the fins, the ring member having an inner diameter greater than the outer diameter of the adjacent part of the cylindrical portion,
- the ring member being retained adjacent the fins by virtue of the indentations, and being capable of rotation with respect to the body member.

One embodiment of this invention is illustrated in the accompanying drawings, in which like numerals denote like parts throughout the several views, and in which:

FIG. 1 is a perspective view of a sucker rod scraper in accordance with this invention;

FIG. 2 is a partial section and partial elevation of a well tube, a sucker rod within the tube, and the sucker rod scraper of this invention applied to the sucker rod;

FIG. 3 is an axial view of one portion of the scraper; and

FIG. 4 is a transverse sectional view taken at the line 4—4 in FIG. 2.

Attention is first directed to FIG. 1, which shows a sucker rod scraper 10 comprising a plastic body member 12 preferably of nylon, adapted to be affixed to a sucker rod 14 in the manner shown in FIG. 2. The body member 12 includes an elongated, generally cylindrical portion 13 with a reduced diameter in its middle part 15, and a plurality of longitudinal fins 16 which extend radially outwardly from the cylindrical portion 13 and which are spaced angularly from each other. In the embodiment shown, there are four fins 16 spaced at 90° intervals around the cylindrical portion 13. As can be seen, each fin is tapered in both directions in order to minimize resistance to the downward movement of the scraper with respect to oil in the well tubing.

Each fin 16 is shaped to define, along its outer edge, an inward recess 18 having a longitudinal rectilinear edge parallel to the sucker rod 14, and two end edges which define the limits of the recess.

The scraper of this invention further includes a plastic ring member 20 which is adapted to encircle the body member 12 adjacent the fins 16. The axial dimension of the ring member 20 is such as to permit it to register in the recesses 18 defined by the fins 16 with a small amount of play in order to allow rotation of the ring with respect to the body member 12. However, the inner diameter of the ring member 20 is only slightly greater than the distance between the inner edges of opposed recesses 18, so that the end edges of the recesses 18 are adapted to interfere with longitudinal movement of the ring member 20 with respect to the body member 12, and retain the ring member in position. This arrangement is particularly clear from FIGS. 1 and 2.

Since the inner longitudinal edges of the recesses 18 are spaced outwardly from the adjacent part of the body portion 12, it will be appreciated that there will remain substantial openings or gaps in the structure between the ring member 20 and the body member 12. These gaps are indentified by the numeral 21 in the sectional view of FIG. 4.

As particularly seen in FIG. 1, the ring member 20 includes a plurality of helically inclined scraper blades 23 projecting outwardly from it. In the preferred construction, the scraper blades 23 are integral with the remainder of the ring member 20. The ring member 20 is split at 25 to permit it to be expanded during application to or removal from the body member 12. In all of the figures, the ring member 20 is shown in its unstressed condition, in which longitudinal movement with respect to the body member 12 is restrained due to the configuration of the recesses 18.

Preferably, the angular slope of each blade 23 is such as to allow it to span a substantial portion of the gap between each adjacent pair of blades, as viewed axially. In the illustration of FIG. 3, it can be seen that each blade extends a major portion of the way between the interblade gaps. The purpose for this helical arrangement of the blades 23 is to avoid the necessity of having to rotate the sucker rod 14 at intervals during its use in order to remove paraffin from the full inner periphery of the well tubing 27.

As seen in FIGS. 1 and 2, the blades 23 are preferably chamfered at one end in order to minimize resistance to liquid moving with respect to the scraper. In FIG. 1 the chamfer 28 is illustrated in the uppermost position, but it is to be understood that in use the chamfer would be downwardly within the wall in view of the fact that the movement of the oil is always upwardly with respect to the scraper.

It will be appreciated that the number of fins and the number of blades is not critical to this invention. In fact, means other than the helical blades 23 could be provided on the exterior of the ring while still retaining the basic advantages of this invention. For example, a plurality of outwardly projecting posts distributed evenly over the outer surface of the ring member 20 would be expected to function satisfactorily.

It will also be appreciated that, for example, by providing only three fins 16 it may be possible to avoid having to split the ring member 20 as at 25. In other words, it may be possible to provide a ring member 20 of sufficient resilience to be able to deform to the required degree during application and removal, without requiring a split.

The body member 12 would normally be injection moulded on site directly around the sucker rod 14, in order to ensure a secure and slip-free grip between these two. The ring member 20 would then be applied after the moulding of the body member 12. Prior to the injection moulding of the body member 12, the sucker rod could be shot blasted in order to roughen its surface to improve the gripping action.

It will be appreciated that the sucker rod scraper provided herein yields a number of advantages.

Firstly, the full interior periphery of the well tubing can be scraped without requiring rod rotating equipment. Secondly the scraper ring is easily replaceable without requiring the replacement of the body member 12. Since the ring member 20 is the only portion undergoing any substantial wear, and since it is so easily removed and replaced by another ring member, continuous utilization of a sucker rod string can be contemplated without requiring the same to be passed again through the injection moulding equipment for the application of new scraper body members.

The nylon material which is the preferred substance for both parts of this invention is resistant to acid well conditions and tends to resist paraffin accumulation on the scraper parts themselves.

A further advantage relates to the numerous passageways and channels through the assembled scraper to allow passage of the cruide oil. It is intended that the outer periphery of the ring member 20, including the outer limit of the blades 23, be only slightly smaller than the interior periphery of the oil well tubing 27. However, as seen in FIG. 4, this provides a plurality of helically arranged channels 31 between adjacent pairs of blades 23, as well as the main internal channels 21 already discussed.

The use of plastic, and particularly nylon, will yield a scraper which is not capable of damaging the oil well tubing through mechanical wear.

Since nylon is inert in the electrolytic sense, there is no electrolytic action between the scraper and the sucker rod as would occur with the use of dissimilar metals.

Finally, the scraper provided herein acts as a rod centralizer within the oil well tubing 27, and this will tend to reduce any wear between the couplings joining adjacent lengths of the sucker rod and the interior wall of the tubing.

I claim:

1. A sucker rod scraper comprising:

a plastic body member adapted to be affixed to the sucker rod, the body member including an elongated, generally cylindrical portion to concentrically surround the sucker rod, a plurality of longitudinal fins extending radially from said cylindrical portion and spaced angularly from each other, the fins being indented between their ends, a plastic ring member adapted to encircle said body member adjacent the fins, within the indentations of the fins, the ring member having an inner diameter greater than the outer diameter of the adjacent part of the cylindrical portion, the ring member being retained adjacent the fins by virtue of the indentations, and being capable of rotation with respect to the body member.

2. The invention claimed in claim 1, in which the ring member includes helically inclined scraper blades projecting outwardly from the ring member integrally therewith.

3. The invention claimed in claim 1, in which the ring member is split to permit it to expand when it is applied to the body member, and in which there are four fins spaced at 90° intervals.

4. The invention claimed in claim 5 in which the ring member includes a plurality of helically inclined scraper blades projecting outwardly from it, the angular slope of each blade spanning a substantial portion of the gap between each adjacent pair of blades, as viewed axially.

5. The invention claimed in claim 6, in which each fin tapers in both directions to minimize resistance to liquid passing through the scraper, and in which the blades are chamfered at one end of the ring member.

6. The invention claimed in claim 7, in which the body member and the ring member are both of nylon.

* * * * *